United States Patent [19]

Paspek

[11] 4,302,207

[45] Nov. 24, 1981

[54] SULFUR GETTER EFFICIENCY

[75] Inventor: Stephen C. Paspek, North Royalton, Ohio

[73] Assignee: Standard Oil Company, Cleveland, Ohio

[21] Appl. No.: 108,101

[22] Filed: Dec. 28, 1979

[51] Int. Cl.[3] ..... C10L 9/02

[52] U.S. Cl. ..... 44/1 R; 44/15 R; 44/6

[58] Field of Search ..... 44/1 R, 1 SR, 6, 16 R, 44/26

[56] References Cited

U.S. PATENT DOCUMENTS

| | | | |
|---|---|---|---|
| 697,234 | 4/1902 | Chailly | 44/16 R |
| 780,308 | 1/1905 | Schmidt | 44/16 R |
| 824,680 | 6/1906 | Zuiderhoek | 44/26 |
| 889,518 | 6/1908 | Giles | 44/16 R |
| 1,995,366 | 3/1935 | Snell | 44/26 |
| 3,756,791 | 9/1973 | Mancke | 44/1 SR |
| 4,174,953 | 11/1979 | Sun et al. | 44/1 SR |

FOREIGN PATENT DOCUMENTS

| | | | |
|---|---|---|---|
| 17863 | of 1901 | United Kingdom | 44/16 C |

*Primary Examiner*—Carl F. Dees

*Attorney, Agent, or Firm*—John E. Miller, Jr.; Herbert D. Knudsen; Larry W. Evans

[57] ABSTRACT

The efficiency with which a sulfur getter such as limestone captures sulfur produced during combustion of a coal getter mixture is enhanced by intimately mixing the coal and the getter together in the form of an aqueous slurry also containing a gelling agent.

11 Claims, No Drawings

SULFUR GETTER EFFICIENCY

BACKGROUND OF THE INVENTION

The present invention relates to a novel technique for improving the getter efficiency of calcium compounds in removing sulfur from coal.

A large number of small industrial boilers, originally designed for stoker coal, are now operated on gas and oil. While these fuels are more expensive, they offer advantages of ease of handling, cleanliness of operations, and low levels of stack gas emissions. However, due to increasingly limited availability of these fuels, the market for coal has once again expanded. The EPA and industrial requirements demand a method of burning moderate to high sulfur coal efficiently while limiting stack emissions of particulates and $SO_2$ to the prescribed levels. Current technology gives several alternatives which permit the use of high sulfur coal.

For example, stack gas scrubbing, involving the passing of combustion products through beds of solid sorbants or through solutions of calcium, sodium and/or magnesium, are quite effective at removing $SO_2$ and particulates. However, their high initial cost coupled with fouling tendencies makes this option unattractive to all but the larger utilities.

Dry injection of limestone into stack gas is a rather ineffective method for controlling sulfur emissions. The formation of an impervious $CaSO_4$ crust around the limestone particles renders the interior virtually useless for sulfur control purposes. Consequently, only 25% to 40% of the calcium injected is actually reacted. Furthermore, excessive amounts of particulates and ash are generated.

Dry injection of limestone into a pulverized coal bed has the same limitations as the previous technique. While small amounts of sulfur can be economically removed, the vast excess of limestone required negates the use of this method for the combustion of high sulfur coal.

Bricketing or pan-balling mixtures of coal, limestone and optionally a binder such as starch have also been suggested. However, sulfur capture has been found to be very low in these techniques as well.

Accordingly, it is an object of the present invention to provide a new technique for reducing the sulfur emissions produced by the burning of sulfur-containing coal. In addition, it is another object of the present invention to provide a new coal-containing material made from sulfur-containing coal which when burned emits very small amounts of objectionable sulfur-containing materials such as sulfur dioxide.

SUMMARY OF THE INVENTION

These and other objects are accomplished in accordance with the present invention which is based on the discovery that the getter efficiency of calcium for encapturing sulfur during the burning of coal can be remarkably enhanced if the coal and the calcium-containing compound are vigorously mixed in the form of an aqueous slurry also containing a gelling agent. The material so obtained can be burned directly or dried and then burned.

Thus, the present invention provides an improvement in the known process for reducing the emission of sulfur dioxide during the combustion of sulfur-containing coal wherein a calcium compound is mixed with the coal to capture sulfur liberated during combustion, the improvement in accordance with the invention wherein the coal and the calcium-containing compound prior to combustion are mixed together in an aqueous slurry also containing a gelling agent.

In addition, the present invention provides a novel coal-containing composition comprising powdered coal, a calcium-containing compound, a gelling agent and water, the composition containing sufficient gelling agent and water so that the composition is a gel.

DETAILED DESCRIPTION

In accordance with the present invention, a mixture of coal and a calcium-containing compound is formed into an aqueous slurry and caused to gel by the addition of a gelling agent thereto. The gel so produced can be used as is, but is preferably dried before or after forming into discrete agglomerates, extrudates, brickets or pan-balls.

Coal

Any type of coal can be processed in accordance with the present invention. Normally the coal will be comminuted such that 80% of the coal is no bigger than 10 mm., preferably 1 mm. Most preferably the coal is less than 200 mesh.

Calcium-Containing Compound

As is well known, calcium-containing compounds such as calcium oxide readily take-up and bind sulfur during combustion of coal. In accordance with the present invention, any calcium compound exhibiting this property can be employed. Broadly such compounds can be described as any calcium-containing compound which will decompose to the oxide form under coal combustion temperatures. Examples of such compounds are calcium oxide, calcium carbonate, calcium hydroxide and organic-containing calcium compounds such as calcium naphthanate and the like. Normally, calcium oxide (lime) and calcium carbonate (limestone) are preferred since they are least expensive.

If the calcium compound is supplied in the form of a solid, normally the solid should be comminuted such that 80% thereof is no bigger than 10 mm., preferably 1 mm. Even better results are obtained if the solid calcium-containing compound is between 40 and 80 mesh, and most preferred results are obtained at 200 mesh or finer.

The amount of calcium-containing compound mixed with the coal varies widely and is dependent primarily upon the amount of sulfur in the coal. The amount of calcium-containing compounds can vary as much as between 0.5 and 5 times the stoichiometric amount of sulfur, with 1 to 2.5 times the amount of sulfur on a stoichiometric basis being preferred. Since it is desirable to capture as much sulfur as possible, it is beneficial to employ at least the stoichiometric amount of calcium-containing compound. Using amounts of calcium-containing compound over about 2.5 times the sulfur content on a stoichiometric basis provides limited improvement in sulfur getter efficiency.

Water

The comminuted coal and calcium-containing compounds are mixed together in the form of an aqueous slurry. The amount of water in the slurry is preferably just enough to make the composition easily mixable and is normally around 15% to 20% by weight, based on the weight of the coal. As little as 10% and as much as 75% water can be tolerated although amounts less than about 10% and greater than about 30% water are rarely used.

In this connection, it has been suggested in connection with a technique for pan-balling a dry coal/limestone mixture to add small amounts of water and a starch binder thereto the improve the pan-balling operation. In that technique, only enough water and binder were added to agglomerate the dry ingredients. A slurry is not formed. The instant invention differs from that technique in that enough water is added in the instant invention so that the coal/calcium-containing compound mixture forms an aqueous slurry which will actually separate into solid and aqueous phases if allowed to settle.

Once the aqueous slurry is formed, it is subjected to vigorous mixing so as to cause a homogeneous or near homogeneous distribution of the calcium-containing compound and the coal.

Optional Catalyst

In a preferred embodiment of the invention, an iron-containing compound is also included in the aqueous slurry. In accordance with the present invention, it has also been found that certain iron compounds will improve the getter efficiency of the calcium-containing compounds.

Any iron-containing compound which is susceptible to oxidation at the coal combustion conditions can be used for this purpose. Of course it is preferable to avoid using compounds which will be corrosive at the combustion conditions, such as iron halides and nitrates. Examples of appropriate compounds are various iron oxides, iron carboxylate, iron napthalate and the like. The amount of iron compound can vary widely and is normally between about 0.05% and 5%, preferably 0.1% to 1% and most preferably about 0.5% measured as metal and based on the weight of the coal. The iron-containing compound can be added before, during or after formulation of the slurry.

Gelling Agent

Any chemical which is capable of causing water to gel can be employed as the gelling agent in the present invention. For example, inorganic materials such as silicates, aluminates, aluminosilicates and carbonates of alkali metals and/or Group IIA metals can be employed. Sodium and potassium silicates, aluminates and aluminosilicates are preferred.

Organic materials can also be employed. Examples of organic gelling agents are starches, pectins and sugars such as molasses. A preferred group of organic gelling agents are acrylamide polymers, and a particularly preferred gelling agent is known as H-Span, which is described as a graft terpolymer of starch, acrylamide and sodium acrylate, the technical name for which is starch-g-poly(acrylamide-cosodiumacrylate).

The amount of gelling agent added to the aqueous slurry can vary widely and depends on a number of factors such as the identity of the gelling agent and the pH of the system. It can be determined in each case very easily by routine experimentation. Preferably, the amount of gelling agent added should be sufficient to make the system a gel, although lesser amounts can be used.

In this regard, it has been found that the unique improvement in sulfur getter efficiency made possible by the present invention occurs even when not enough gelling agent is added to make the system gel. In these situations, the magnitude of improvement in getter efficiency increases as the amount of gelling agent increases, with the system usually assuming a thick mud-like consistency instead of a gel form. Best getter efficiency, however, is obtained when enough gelling agent is added to make the system a gel, and hence this is preferred.

Also, it has been found that once enough gelling agent is added to make the system gel, no significant additional sulfur capture is realized by increasing the gelling agent content. Therefore, the amount of gelling used is preferably enough to make the system a gel but not a great deal more.

As examples of amounts of gelling agents to use, it has been found that when the gelling agent is H-Span, the amount added is normally about 0.2 to 0.8%, preferably 0.4%, based on the weight of the coal. When the gelling agent is sodium silicate, the amount added is preferably about 1% to 8%, more preferably about 4%.

The gelling action of many gelling agents, as is well known, is dependent upon the pH of the system. Therefore, the pH should be adjusted so as to maximize the gelling effect of the particular gelling agent and hence minimize the amount of gelling agent required. Normally, the gelling agent is added last, and the pH in such instance can be suitably adjusted either before or after the addition of the gelling agent. If desired, however, the gelling agent can be added before the final slurry is compounded, in which case it is desirable to make the final pH adjustment after the system is subjected to vigorous mixing. In many systems, however, no pH adjustments are necessary, and in these instances it is desirable to add the gelling agent last.

Product

The above procedure produces a product containing the calcium-containing compound, sulfur-containing coal, and optionally the iron-containing catalyst, and which is in the form of a thick mud-like material or a gel. This material normally contains from about 10 to 50 weight percent water, depending upon the particular gelling agent employed. It can be used as is, that is simply burnt, but more preferably it is dried before combustion. Drying can be accomplished in any conventional manner such as by leaving the gel in ambient air for a few hours. Of course, the larger the bulk of the product the longer will be the drying time. Simple air drying will remove most of the water, and heating in air at a relatively mild temperature, e.g. 125° F., will remove substantially all water. In accordance with a preferred aspect of the invention, it is desirable to form the product into dried agglomerates or pellets such as for example by extrusion (if the material is a gel), followed by drying, or by drying the material first and then bricketing, or by partially drying the material to form a thick wet paste-like system and then pan-balling. Materials produced by these techniques comprise low-moisture content agglomerates of coal and calcium which when burned give off relatively low amounts of noxious sulfur compounds such as sulfur dioxide. If desired, these dried materials can be ground and used as a combustion source in a fluid-bed combustor.

WORKING EXAMPLES

The following working examples are presented to provide a more thorough understanding of the present invention.

Comparative Examples A thru J and Examples 1 thru 26

A number of different aqueous slurries were prepared from an Indiana West Field 5 coal containing 5.25% sulfur (3.71% pyritic, 1.45% organic and 0.09% sulfate) and having a fuel value of 11,650 BTU/lb. The coal was crushed and screened so that 49 weight percent of the coal was greater than 200 mesh and 51 weight percent of the coal was less than 200 mesh. The slurries were formed by mixing 25 gms. of powdered coal, lime or limestone, gelling agent when used, and enough water to enable easy homogenization of the mixture. Generally, 25 to 75 ml. was sufficient. The mixture was magnetically stirred to ensure homogenity of the slurry, and then partially dried at 125° C. The thickened slurry was then extruded through a ¼ inch nozzle and dried at 125° C. for 2 hours.

Some slurries were ball-milled before being extruded. Ball-milling was generally carried out for 4 hours at about 100 rpm in a ceramic jar with 0.5 inch stainless steel balls. A small amount of additional water was employed to wash the coal slurry from the mill and balls after the operation.

A sample of approximately 1 gm. of each dried extrudate was weighed, placed into a tared Coors combustion boat and inserted into a 750° C. tube furnace which was flushed with oxygen to assure complete combustion while minimizing linear gas velocity and thus minimizing the loss of ash from the system. In general, at a furnace temperature of 750° C. the coal sample spontaneously ignited within 5 seconds of insertion, raising the temperature to approximately 1,000° F. for 40 seconds. As the coal was consumed, the temperature gradually fell to the 750° C. level, this taking approximately 90 seconds. The combustion boat was removed after 1 hour, cooled in a dessicator, and weighed. The results obtained are set forth in the following Tables I to III.

TABLE I

| Example | Ca Source | Ca/S Ratio (Stoich) | Catalyst | Wt % | Wt % Ash | % S Captured |
|---|---|---|---|---|---|---|
| Comp A | — | — | — | — | 18.6 | 9.1 |
| Comp B | $CaCO_3$ | 1.80 | — | — | 33.6 | 55.0 |
| Comp C | $CaCO_3$ | 1.80 | $Fe_2O_3$ | 0.5 | 33.6 | 69.0 |
| Comp D* | $CaCO_3$ | 1.80 | $Fe_2O_3$ | 0.5 | 33.6 | 70.0 |
| Comp E | $CaCO_3$ | 0.87 | $Fe_2O_3$ | 0.5 | 30.7 | 35.0 |
| Comp F* | $CaCO_3$ | 0.87 | $Fe_2O_3$ | 0.5 | 35.2 | 39.0 |
| Comp G | CaO | 1.80 | — | — | 35.9 | 53.0 |
| Comp H | CaO | 1.80 | $Fe_2O_3$ | 0.5 | 36.8 | 54.0 |
| Comp I | CaO | 0.87 | $Fe_2O_3$ | 0.5 | 33.8 | 54.0 |

TABLE I-continued

| Example | Ca Source | Ca/S Ratio (Stoich) | Catalyst | Wt % | Wt % Ash | % S Captured |
|---|---|---|---|---|---|---|
| Comp J* | CaO | 0.87 | $Fe_2O_3$ | 0.5 | 34.7 | 57.0 |

*Ball-milled.

As can be seen from Comparative Examples A through F, iron oxide is a good catalyst, improving sulfur capture 14% over simple physical coal-limestone ($CaCO_3$) mixtures. At low calcium levels, the positive effect of the closer calcium-sulfur contacting afforded by ball-milling is evident. This effect is masked at higher calcium concentrations. Calcium utilization in the physical mixture (Comparative Example B) is 30% while the addition of iron oxide raises utilization levels to 40% to 45%, the efficiency of calcium usage decreasing as the calcium level increases.

Comparative Examples G thru J show that lime (CaO) is a more effective sulfur capture agent than limestone at low calcium levels. The beneficial effects of ball-milling are again evident. However, increasing the level of calcium oxide does not produce an associated increase in sulfur capture.

TABLE II

| | | Sodium Aluminate and Sodium Silicate Gelling Agents* | | | | | |
|---|---|---|---|---|---|---|---|
| Example | Ca Source | Stoich | Gelling Agent | Wt % | Wt % Ash | %S Captured | Form |
| 1 | $CaCO_3$ | 0.87 | $NaAlO_2$ | 2.1 | 32.2 | 64 | thick "mud" |
| 2*** | CaO | 0.87 | $NaAlO_2$ | 2.3 | 37.4 | 56 | " |
| 3 | CaO | 0.87 | $NaAlO_2$ | 2.3 | 33.5 | 66 | " |
| 4 | CaO | 0.87 | $NaAlO_2$ | 4.4 | 34.2 | 69 | gel |
| 5** | CaO | 0.87 | $NaAlO_2$ | 8.4 | 38.9 | 70 | " |
| 6 | CaO | 1.10 | $NaAlO_2$ | 4.5 | 35.2 | 70 | " |
| 7** | CaO | 1.10 | $NaAlO_2$ | 8.3 | 38.0 | 75 | " |
| 8 | CaO | 2.00 | $NaAlO_2$ | 4.0 | 39.6 | 75 | " |
| 9 | CaO | 1.10 | $Na_2SiO_3$ | 4.4 | 33.0 | 58 | " |
| 10 | CaO | 1.10 | $Na_2SiO_3$ | 8.3 | 34.1 | 60 | thick "mud" |
| 11 | CaO | 1.10 | $Na_2SiO_3$ | 8.3 | 33.8 | 76 | gel |

*All samples contain 0.5 weight percent iron oxide and Example 11 contains 1% $HNO_3$.
**Ball-milled.
***Large excess of water.

As can be seen from Examples 1 to 8, when the gelling agent is sodium aluminate, gels were formed when the gelling agent content was 4 weight percent or above while thick muds were formed when the amount of gelling agent was less than 4 weight percent. In addition, the performance of lime and limestone are essentially comparable. Moreover, increasing the amount of sodium aluminate at a fixed calcium level results in an increased sulfur capture and likewise increasing the calcium level also increases sulfur capture. However, a plateau is reached for both the gelling agent concentration and calcium concentration. Ball-milling has very little effect upon sulfur capture, even at low calcium levels.

Examples 9 to 11 show that increasing the amount of sodium silicate increases sulfur capture, as does acidification of the slurry.

Comparison of Examples 1 to 11 with Comparative Examples A to J shows that sulfur capture is significantly enhanced by incorporating a gelling agent into the slurry and then homogenizing the system.

Examples 12 to 14 and Comparative Examples K to V

Examples 1 to 11 were repeated using various different gelling agents and other additives. All samples used calcium oxide as the calcium source in an amount of 1.1 times the stoichiometric amount of sulfur. All samples except that of Example 20 contain 0.5 weight percent iron oxide as catalyst. The identities of the gelling agents and additives and the results obtained are set forth in the following Table III.

TABLE III

| Example | Additional Gelling Agents: Gelling Agent/ Additives | Wt % | Wt % Ash | Form of Product | %S Captured |
|---|---|---|---|---|---|
| 12 | $NaHCO_2$ | 8.30 | 39.3 | gel | 82 |
| 13 | $Na_2CO_2$ | 8.30 | 35.1 | " | 79 |
| 14 | $K_2CO_3$ | 8.30 | 36.2 | " | 82 |
| Comp K | Monawet Surfactant | 0.02 | 33.8 | thick slurry | 62 |
| Comp L | Monawet Surfactant | 0.90 | 38.2 | thick slurry | 54 |
| Comp M | Ethylene Diamine Tetra-acetic Acid | 1.00 | 31.5 | thick slurry | 61 |
| Comp N | Molecular Seives | 4.40 | 35.0 | thick slurry | 61 |
| Comp O | $P_2O_5$ | 0.50 | 34.0 | thick slurry | 59 |
| Comp P | $P_2O_5$ | 0.50 | 35.1 | thick slurry | 44 |
| Comp Q | $NH_4OH$ | 2.60 | 34.8 | thick slurry | 53 |
| Comp R | Fly Ash | 15.30 | 43.9 | thick slurry | 51 |
| Comp S | $BaCO_3$ | 0.50 | 38.6 | thick slurry | 50 |
| Comp T | $Al_2O_3$ | 2.00 | 32.9 | thick slurry | 44 |
| Comp U | $SiO_2$ | 8.30 | 36.0 | thick slurry | 44 |
| Comp V | $Mn_2O_3$ | 0.50 | 33.7 | thick slurry | 37 |

As can be seen, many other gelling agents also provide excellent sulfur capture properties.

Examples 15 to 30

Examples 1 to 11 were repeated using a number of different coals and a number of different gelling agents. In each slurry calcium oxide was used as the calcium source and was present in an amount of 2.2 times the amount of sulfur on a stoichiometric basis. In addition, the furnace temperature was maintained at 1,050° C. The type of coal, the identity and amount of the gelling agent and the percent sulfur capture are set forth in the following Table IV.

TABLE IV

| Example | Coal | % S | Gelling Agent | Wt % | %S Capture |
|---|---|---|---|---|---|
| 15 | Ill. #6 | 1.2 | — | — | 50–55 |
| 16 | " | " | $NaAlO_2$ | 4.4 | 75–80 |
| 17 | " | " | Pectin | 0.4 | 75–80 |
| 18 | " | " | H-Span | 0.4 | 75–80 |
| 19 | " | " | Molasses | 0.4 | 60–65 |
| 20 | " | " | $NaAlO_2$ | 4.4 | 85–90 |
| | | | Fe Carboxy. | 0.5 | |
| 21 | " | 2.5 | $NaAlO_2$ | 4.4 | 70–75 |
| 22 | " | " | H-Span | 0.4 | 70–75 |

TABLE IV-continued

| Example | Coal | % S | Gelling Agent | Wt % | %S Capture |
|---|---|---|---|---|---|
| 23 | Ohio #5 | 2.8 | $NaAlO_2$ | 4.4 | 70–75 |
| 24 | " | " | H-Span | 0.4 | 70–75 |
| 25 | Ind. #5 | 3.5 | — | — | 50–55 |
| 26 | " | " | $NaAlO_2$ | 4.4 | 70–75 |
| 27 | " | " | H-Span | 0.4 | 70–75 |
| 28 | Pitt. #8 | 5.3 | — | — | 45–50 |
| 29 | " | " | $NaAlO_2$ | 4.4 | 70–75 |
| 30 | " | " | H-Span | 0.4 | 70–75 |

As can be seen from Table IV, various different gelling agents can be used on various different types of coal to provide high sulfur capture by calcium oxide.

Although only a few embodiments of the present invention have been described, many modification can be made without departing from the spirit and scope of the invention. All such modifications are intended to be included within the scope of the invention, which is to be limited only by the following claims.

We claim:

1. In a process for reducing the emission of sulfur dioxide during the combustion of sulfur-containing coal wherein a calcium compound is mixed with the coal to capture sulfur liberated during combustion, the improvement wherein said coal and said calcium-containing compound prior to combustion are mixed together in an aqueous slurry also containing a gelling agent.

2. The process of claim 1 wherein said aqueous slurry contains sufficient gelling agent so that said aqueous slurry forms a thick mud-like composition.

3. The process of claim 1 wherein said aqueous slurry contains sufficient gelling agent so that said aqueous slurry forms a gel.

4. The process of claim 3 wherein said aqueous slurry contains said calcium-containing compound in an amount of 0.5 to 5 times the amount of sulfur in said coal on a stoichiometric basis.

5. The process of claim 4 wherein said aqueous slurry also contains an iron-containing compound.

6. A fuel composition comprising powdered coal containing sulfur, a calcium-containing compound capable of capturing said sulfur when said composition is burned, a gelling agent and water, said composition containing sufficient gelling agent and water so that said composition is a gel.

7. The composition of claim 6 wherein said gel contains said calcium-containing compound in an amount of 0.5 to 5 times the amount of sulfur in said coal on a stoichiometric basis.

8. The dried product produced by drying the gel of claim 3.

9. The dried product produced by drying the product of claim 1.

10. The process of claim 1 wherein said calcium compound is at least one of $CaCO_3$ and CaO and further wherein said gelling agent is an aluminate, silicate, carbonate or bicarbonate of sodium or potassium.

11. The composition of claim 6 wherein said calcium compound is at least one of $CaCO_3$ and CaO and further wherein said gelling agent is an aluminate, silicate, carbonate or bicarbonate of sodium or potassium.

* * * * *